US006357497B1

(12) United States Patent
Frase

(10) Patent No.: US 6,357,497 B1
(45) Date of Patent: Mar. 19, 2002

(54) KNIT CROCHET BAG

(76) Inventor: Sarah Frase, 182 Pigeon Springs Rd., Onalaska, WA (US) 98570

( * ) Notice: Subject to any disclaimer, the term of this patent is extended or adjusted under 35 U.S.C. 154(b) by 0 days.

(21) Appl. No.: 09/599,816

(22) Filed: Jun. 23, 2000

(51) Int. Cl.[7] ..... A45C 1/02
(52) U.S. Cl. ..... 150/117; 109/111; 206/574; 383/40
(58) Field of Search ..... 150/117; 190/111, 190/902; 383/38–40; 204/574

(56) References Cited

U.S. PATENT DOCUMENTS 4,156,446 A * 5/1979 Nathan ..... 150/117 X
4,301,898 A * 11/1981 Plough et al. ..... 150/117 X
5,150,794 A * 9/1992 Rooks ..... 206/574
5,217,119 A * 6/1993 Hollingsworth ..... 190/902 X
5,813,445 A * 9/1998 Christman ..... 383/38 X
6,085,902 A * 7/2000 Fang ..... 383/39 X

* cited by examiner

*Primary Examiner*—Stephen P. Garbe
*Assistant Examiner*—Tri M. Mai
(74) *Attorney, Agent, or Firm*—Thomas W. Secrest

(57) ABSTRACT

A tote bag for carrying various articles. There is a central storage region with an inside pocket. There is a cover for the central storage region. The bag has sides and there are a plurality of pockets and covers for said pockets on the exterior surfaces of said sides. The bag has ends. There is a pocket on the end and a cover for said pocket. One of the many uses of the tote bag is for receiving yarn and accessories for crocheting.

13 Claims, 8 Drawing Sheets

KNIT CROCHET BAG

BACKGROUND OF THE INVENTION

FIELD OF THE INVENTION

The genesis of this tote bag was in the art of crocheting. A person crocheting needs various yarns and a place to store these yarns. Also, from the yarns there is produced a crocheted article. To produce the crocheted articles it is necessary to have crochet hooks.

From having crocheted various articles I found it necessary to find a bag which could simultaneously store the various yarns and the crocheted article and the crochet hooks. From this background I developed the subject knit crochet bag.

SUMMARY OF THE INVENTION

The tote bag comprises several compartments for carrying and storing various articles. There is a central panel comprising a base with two ends. On the exterior surface of each end there is a pocket for storing an article.

There is a first side panel attached to the base. On the interior surface of the first side panel there is a pocket. The first side panel has an exterior surface and there are a plurality of pockets on the exterior surface.

There is a second side panel attached to the base. The second side panel has an exterior surface and there a plurality of pockets attached to the second side panel on the exterior surface.

The base with two ends and a first side panel and a second side panel define a storage region.

There is a cover flap attached to the upper part of the first side panel and to the upper part of the second side panel. The cover flap is used to cover the storage region.

Yarn can be placed in the pockets on the exterior surface of the first side and on the exterior surface of the second side panel. The crocheted article produced from the yarn can be stored in the storage region. Also, the crochet hooks and related items can be stored in the inner pocket in the storage region.

It is possible to store the yarn in the pockets on the exterior surface of the side panels and to work the yarn into a crocheted article and to store the crocheted article in the storage region without moving the yarn from the pockets and without moving the crocheted article any distance from the storage region.

In effect, there is a tote bag or a knit crochet bag which makes it possible to transport the yarn, the crochet hooks and like items, and the crocheted article in one unit so as to lessen the possibility of losing the crocheted article and also losing the yarn and crochet hooks.

BRIEF DESCRIPTION OF THE SEVERAL VIEWS OF THE DRAWING(S)

In the drawings, it is seen that:

DETAILED DESCRIPTION OF THE INVENTION

Figure 1:
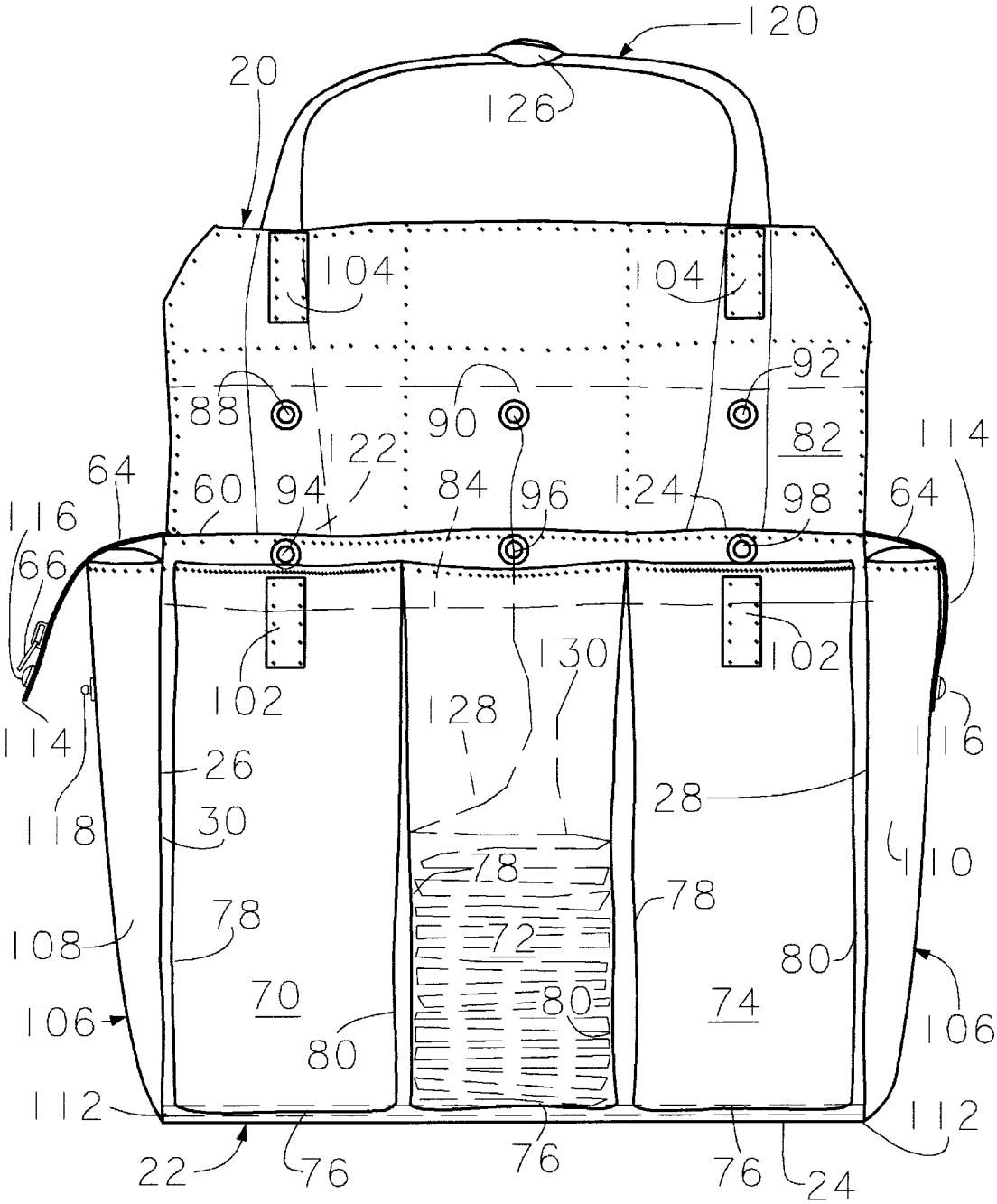
FIG. 1 is a side elevational view of the KNIT CROCHET BAG with the cover flap in an elevated position, and it is to be understood that the other side elevational view is the same.
Figure 2:
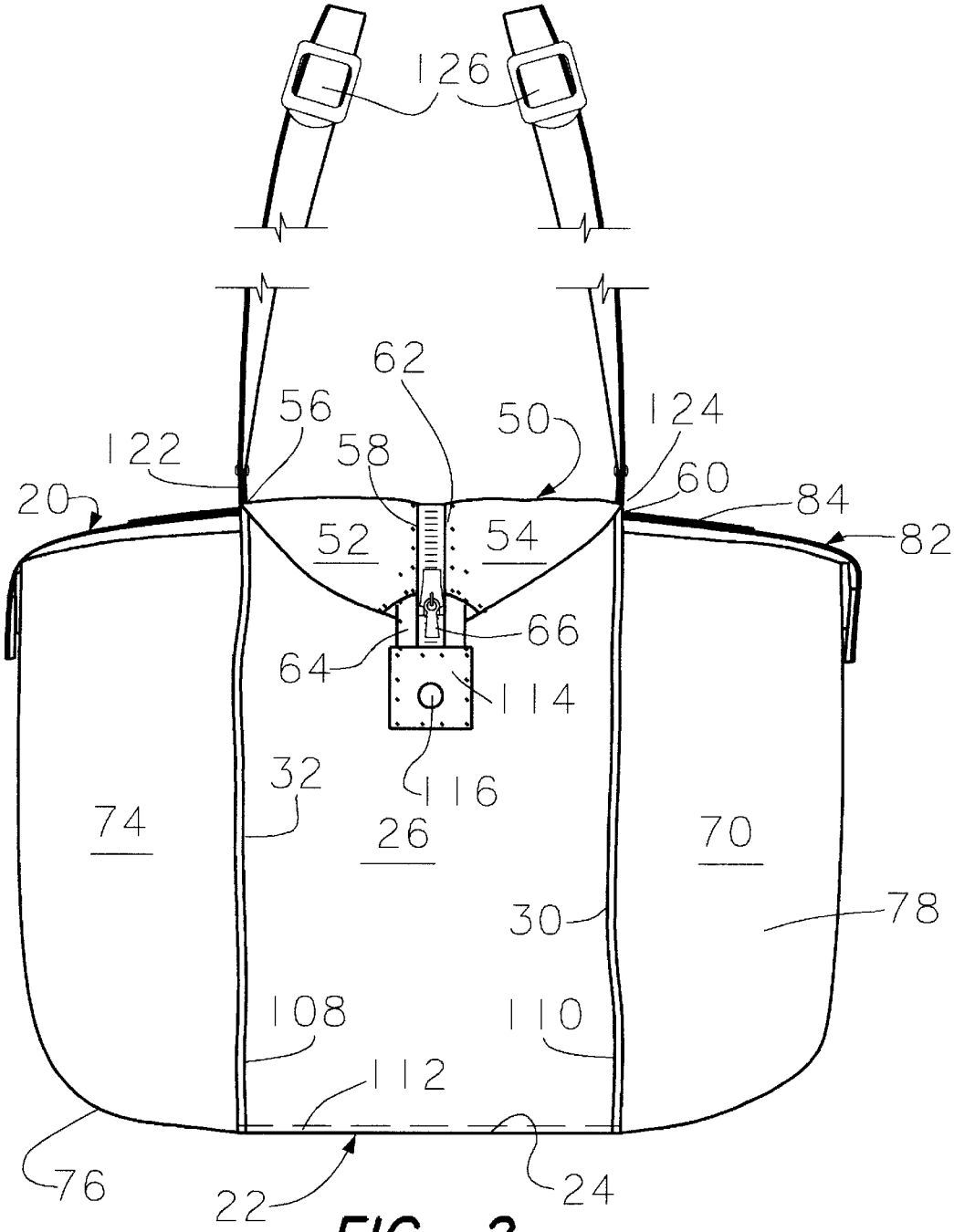
FIG. 2 is an end elevational view with the top central zipper closed and with the top central flap over the central storage pocket.
Figure 3:
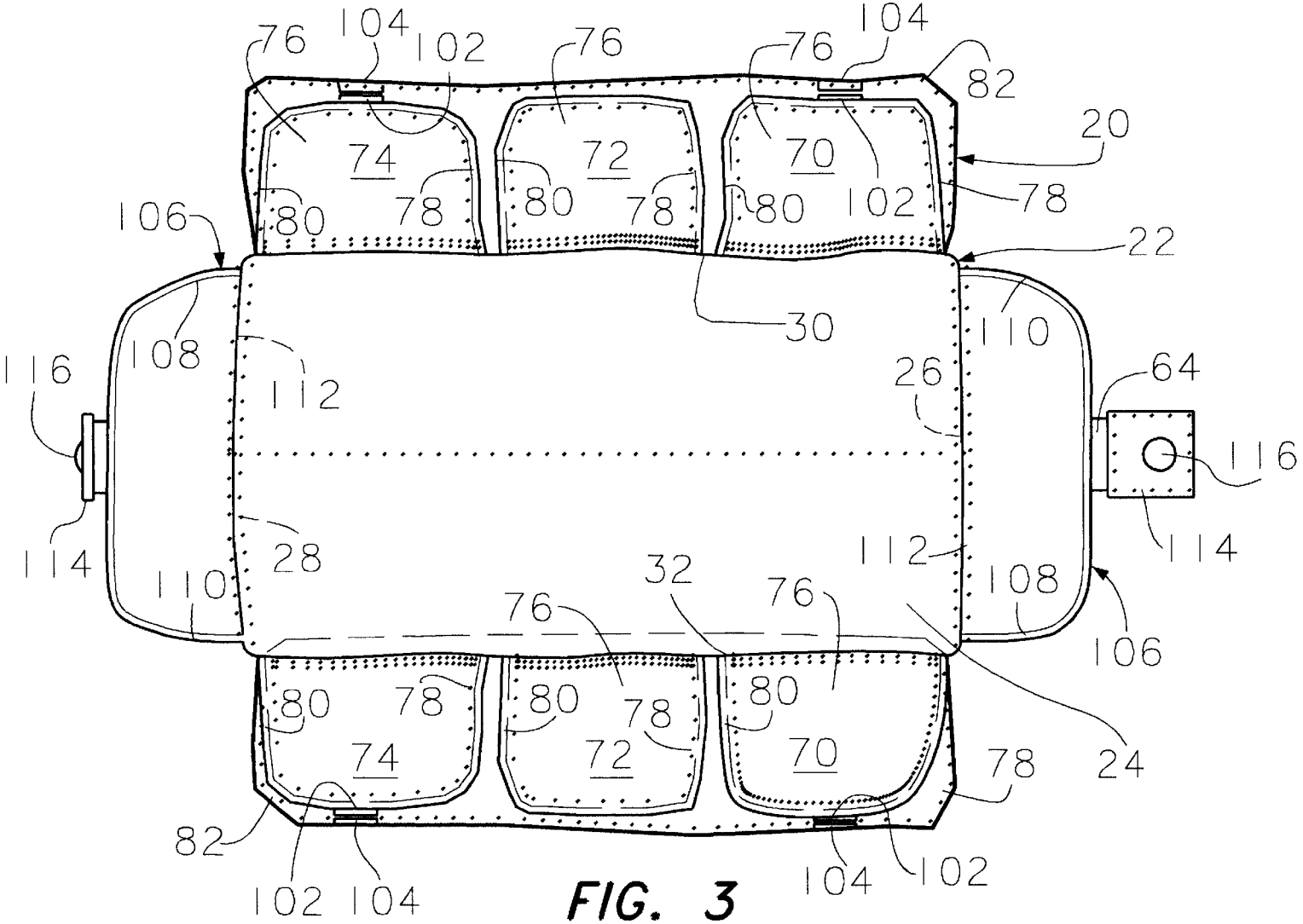
FIG. 3 is a bottom plan view.
Figure 4:
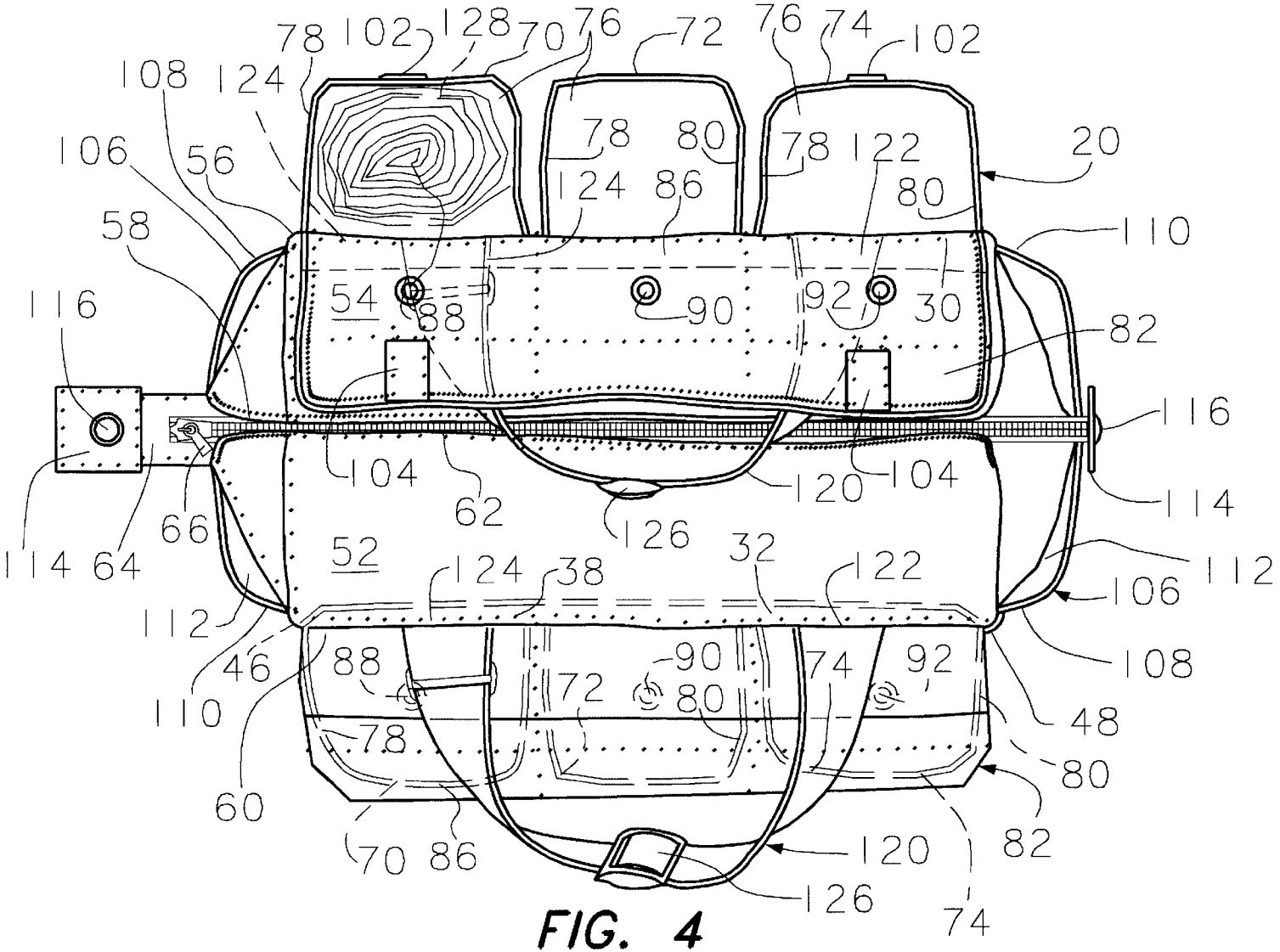
FIG. 4 is a top plan view illustrating the top central zipper closed and on the left the left flap elevated to illustrate three storage pockets and on the right the right flap lowered and covering the three storage pockets.
Figure 5:
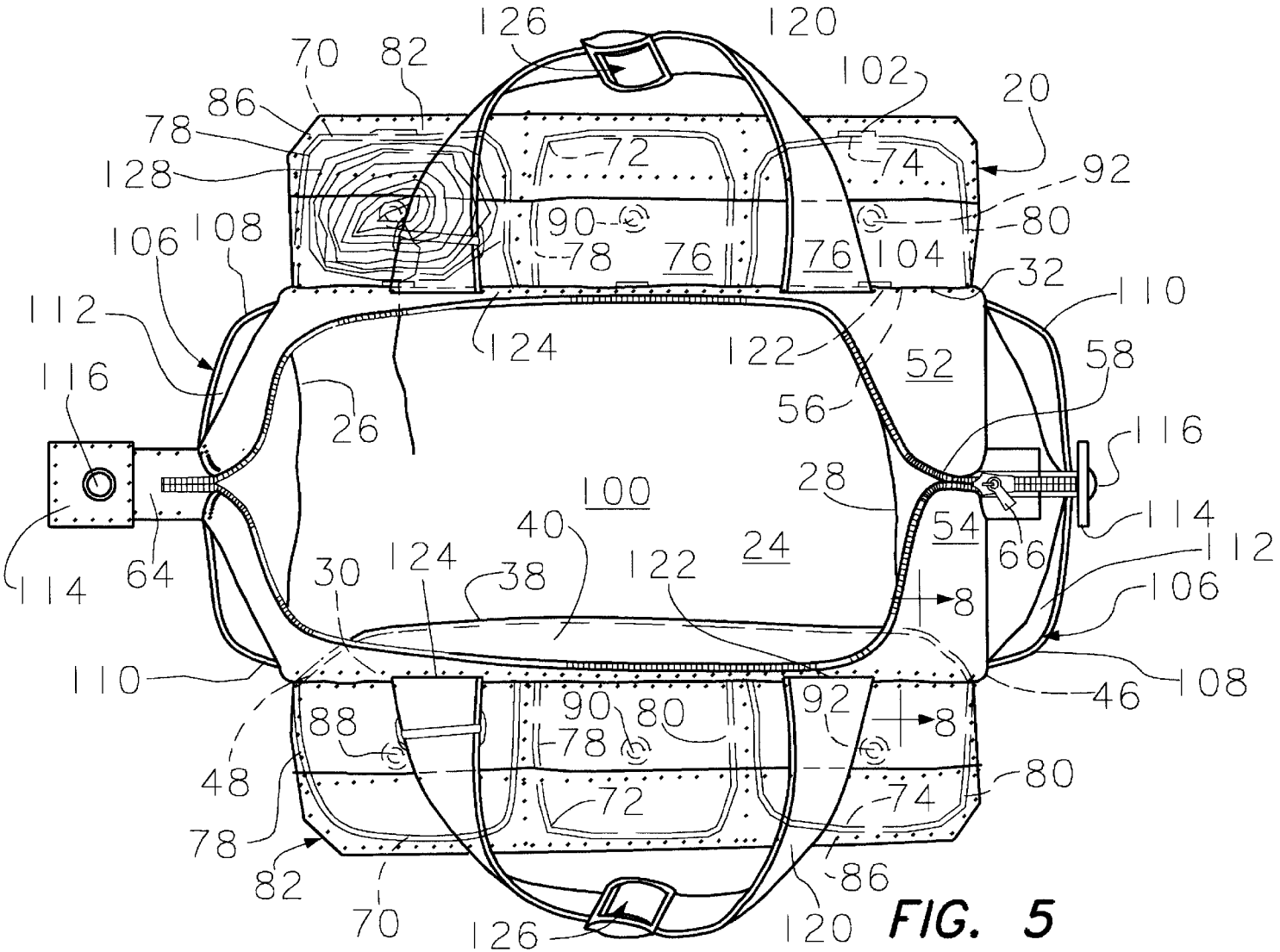
FIG. 5 is a top plan view illustrating the top central zipper in an open position and the top central flap open to disclose the central storage pocket and with the left flap covering the three left pockets and with the right flap covering the three right pockets.

With respect to the drawings it is seen that there is a tote bag 20 comprising a base 24 having a first end 26 and a second end 28. The ends 26 and 28 are on the same side of the base 24 and are, substantially, at a right angle to the base 24.

There is a first side 30 connecting with the base 24 and also with the first end 26 and the second end 28. There is a second side 32 connecting with the base 24 and with the first end 26 and with the second end 28.

The base 24, the first end 26, the second end 28, the first side 30, and second side 32 define a central storage area 100.

There is a lower flap 34 attached to the inside surface of the second side 32. The lower part of the lower flap 34 is attached at 36 to the inside surface of the second side 32. The sides of the lower flap 34 are attached at ends 46 and 48 to the inside surface of the second side 32. The lower flap 34 and the second side 32 define an interior pocket 38.

There is an upper flap 40 attached at 42 to the inside surface of the second side 32.

The upper part of the flap 40 is attached at 32 to the interior surface of the second side 32. The edges of the upper flap 40 are attached at 46 and 48 to the inside surface of the second side 32.

A fastening means 44 connects with the lower flap 34 and the upper flap 40 so that the pocket 38 can be sealed and the contents of the pocket securely positioned in the pocket 38.

The fastening means 44 can be one of many such as a zipper, velcro, buttons, and snaps.

There is a cover 50 for the central storage region. The cover 50 comprises a first member 52 and a second member 54.

The first member 52 has an outer edge 56 and an inner edge 58.

The second member 54 has an outer edge 60 and an inner edge 62.

The outer edge 56 of the first member 52 and the outer edge 60 of the second member 54 can be attached to the upper part of respective sides 30 and 32. The attachment can be by sewing together the two parts. The first member 52 can be sewed to the upper part of the second side 32. The second member 54 can be sewed to the upper part of the first side 30.

The first member 52 and the second member 54 can be joined by one of many joiners such as a zipper, velcro, buttons, and snaps.

In the drawings the two members 52 and 54 are joined by a zipper 64 having a pull tab 66.

On the exterior surface of the first side 30 there are three pockets. The first pocket 70, the second pocket 72, and the third pocket 74.

Each pocket has a bottom 76, a first side 78, and a second side 80. The pockets are parallel to the first side 30 and are open at the top.

There is a cover 82 for the pocket 70, 72, and 74.

The interior side 84 of the cover 82 is attached to the exterior surface of the first side 30 and extends over the open upper end of the pockets 70, 72, and 74.

The exterior side 86 of the cover 82 extends over the open upper end of the pocket 70, 72, and 74 and covers these open upper ended pockets.

In the cover 82 there are openings 88, 90, and 92. The opening 88 is aligned with the pocket 70; the opening 90 is aligned with pocket 72; and the opening 92 is aligned with the pocket 74.

In the upper part of the side 30 there are a plurality of openings 94, 96, and 98 and above the pockets 70, 72, and 74.

The openings 88 and 94 are aligned. The openings 90 and 96 are aligned. The openings 92 and 98 are aligned.

On the exterior surface of the second side 32 there are three pockets identified as 70, 72, and 74. Each pocket has a bottom 76, a first side 78, and a second side 80.

As with the first side 30 there is for the second side 32 a cover 82 for the pockets 70, 72, and 74. There is an interior side 84 attached to the upper part of the second side 32 and which extends over the pockets 70, 72, and 74. The pockets 72 and 74 have an open top for receiving an article or articles.

The exterior side 86 extends over the pockets 70, 72, and 74 and covers the open tops.

In the exterior side 86 are openings 88, 90, and 92.

In the upper part of the second side 32 are openings 94, 96, and 98 and are above the pockets 70, 72, and 74. The opening 88 is aligned with opening 94. The opening 90 is aligned with the opening 96. The opening 92 is aligned with the opening 98. For both the first side 30 and the second side 32 the openings 88 and 94 are aligned with the pocket 70. The openings 90 and 96 are aligned with the pocket 72. The openings 92 and 98 are aligned with the pocket 74.

The cover 82 extends over the pockets 70, 72, and 74 and covers the open top of these pockets.

The openings 88, 90, 92, 94, 96, and 98 may be a passageway in the respective sides 30 and 32 or may be an eyelet such as a metal eyelet having a passageway in it or may be a passageway with the material surrounding the passageway being threaded and sewn to reinforce the material around the passageway.

The cover 82 has an interior surface 84 and an exterior surface 86.

On the exterior surface of the upper part of the pockets 70 and 74 there is a first fastening means 102.

On the interior surface 86 of the cover 82 there is a second fastening means 104. The fastening means 102 and 104 are aligned. The fastening means 102 and 104 may be velcro, a button, a snap ring, so as to firmly position the cover 82 with respect to the pockets and to prevent the accidental discharge of the contents of the pockets out of the pockets.

There is positioned on the exterior surface of the first side 30 or the second side 32 a cover 103. The cover 103 is positioned above the cover 82. The purpose of the cover 103 is to cover the openings 88, 90, and 92 and the cover 82.

With the cover 82 over the pockets and the fastening means 102 and 104 cooperating with each other the contents in the pockets are securely positioned. With the cover 103 over the cover 82 the openings 88, 90, and 92 are not visible. The cover 103 can be attached to the exterior surface of the first side 30 or the second side 32 by means of stitching or thread or glue.

On the exterior surface of the first end 26 or the second end 28 there is a pocket 106. The pocket 106 has a side 108, a side 110, and a bottom 112. The upper part of the pocket 106 is open for receiving an article.

On the zipper 64 there is a handle 114. On each end of the zipper 64 there is an eye receptacle 116 for receiving a projecting knob 118 to form a snap on connection. The projecting knob 118 connects with the exterior surface of the pocket 106.

The ends of the zipper can be firmly attached to the attaching means on the outside surface of the pocket 106. In place of an eye receptacle 116 for projecting knob 118 there can be used velcro or there can be used a button and a button hole.

There are two adjustable straps 120 connecting with the first side 30 or the second side 32.

The adjustable strap 120 has two ends, 122 and 124. One end 122 can be attached to the upper part of the side 30, and the other end 124 can be attached to the upper part of the side 30.

Likewise, the adjustable strap having end 122 can be attached to the upper part of the second side 34, and the other end 124 can be attached to the upper part of the second side 34.

There is an adjustable adjusting buckle 126 for adjusting the length of the strap 120.

Figure 6:
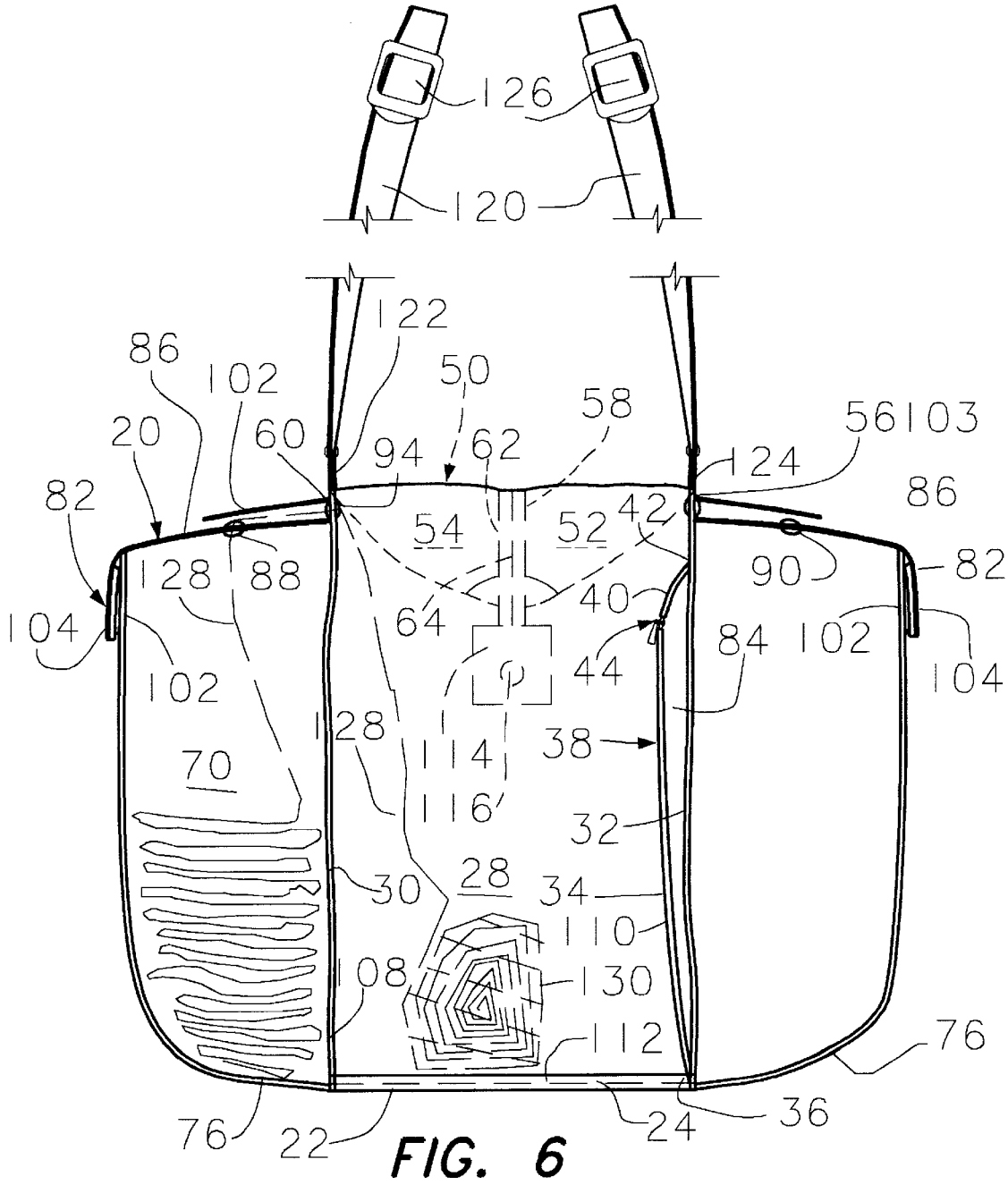
FIG. 6 is a cross-sectional view and illustrates yarn in a side pocket and a crocheted article in the central storage region.
Figure 7:
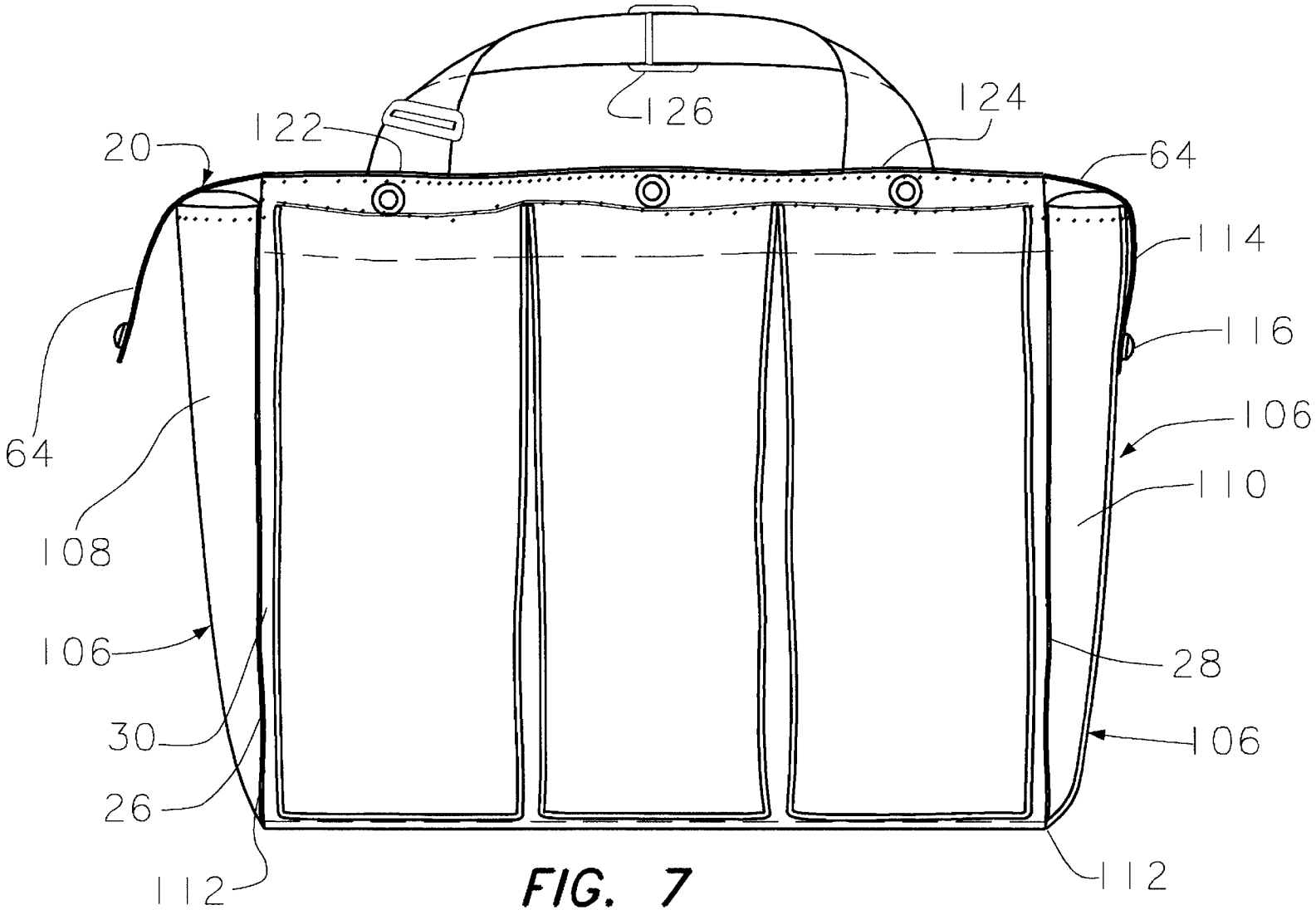
FIG. 7 is a side elevational view with the top central zipper closed and the side flap closed and covering the three side pockets and a flap over each end pocket.
Figure 8:
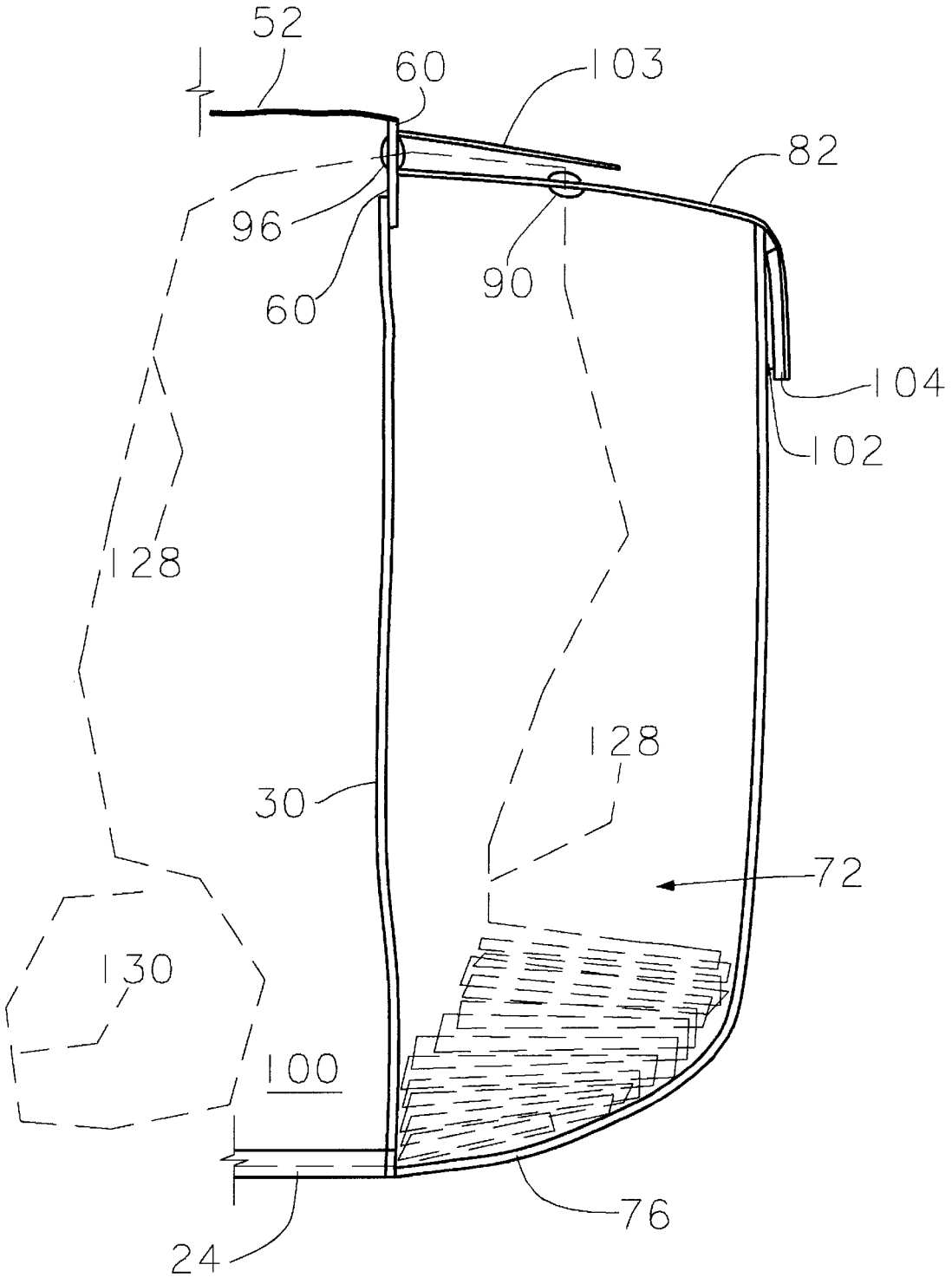
FIG. 8 is a fragmentary cross-sectional view illustrating the central storage region, the side, the cover, the opening or eye in the side, the pocket on the side, the cover for the pocket, and the opening or eye in the cover.

In FIG. 6 it is seen that in the left pocket 70 there is crochet yarn 128. The crochet yarn is led through or positioned in the opening or eyelet 88 in the cover 82. Then, the crochet yarn 128 is positioned in the opening or eyelet 94 in the upper part of the first side 30. The crochet yarn then is in the central storage region 100 and connects.

With this knit crochet bag or tote bag it is possible for a person to have six different yarns to make a crochet item. The crocheted product can be positioned in the central storage region 100. When a person has time to crochet the person can unzip the zipper 64 and open the cover 50 and remove the crochet item and continue to crochet. The crochet yarn 128, in all six of the pockets, is securely positioned and can be utilized by the person doing the crocheting.

After the person has crocheted with the yarn 128 and does not have sufficient time to complete the crochet item 130 the person can place the crochet item 130 in the central storage region 100 and close the cover 50 and zip shut the cover 50.

The implements used for crocheting can be stored in the pocket 38 in the central storage region 100.

The central storage region or central compartment 100 is defined by the base 24, first end 26, second end 28, first side 30, second side 32, and first member 52, and second member 54 of the cover 50.

The materials of construction for the base 24, first end 26, second end 28, first side 30, second side 32, pocket 38, cover 50, pocket 70, 72, and 74, cover 82, pocket 106, and adjustable strap 120 can be many materials of construction. For example cloth such as cotton or wool or cloth made from plastic fiber or a mixture of plastic fiber and cotton and/or wool can be used. The weave can be a loose weave so as to allow air circulation within and through the tote bag. The weave can be a tight weave such as to prevent water entering into the tote bag.

The tote bag can be of a loose floppy construction so as to be easily manipulated and pulled back on itself.

The tote bag can be of leather or simulated leather or of plastic and can be of a tight stiff construction difficult to fold.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; and said central panel and said first side panel and said second side panel defining said storage region.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; a first cover for said storage region; and said first cover connecting with said first side panel and with said second side panel.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; and a second end pocket connecting with said exterior surface of said second end panel.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; and a second side cover connecting with said second side panel and positioned to cover said second side pockets and connected to said second side panel.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; and a fourth side cover connecting with said second side panel and positioned to cover said second side cover.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; a first passageway in said first side cover; said first passageway being aligned with one of said plurality of first side pockets; a second passageway in said first side panel and positioned between said first side cover and said third side cover; and said first passageway and said second passageway being aligned.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; a first passageway in said first side cover; said first passageway being aligned with one of said plurality of first side pockets; a second passageway in said first side panel and positioned between said first side cover and said third side cover; said first passageway and said second passageway being aligned; a first cover for said storage region; said first cover connecting with said first side panel and with said second side panel; said first cover comprising a first member and a second member; said first member having a first connecting means; said second member having a second connecting means; and said first connecting means and said second connecting means being capable of uniting to form said first cover.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; a first passageway in said first side cover; said first passageway being aligned with one of said plurality of first side pockets; a second passageway in said first side panel and positioned between said first side cover and said third side cover; said first passageway and said second passageway being aligned; a first cover for said storage region; said first cover connecting with said first side panel and with said second side panel; said first cover comprising a first member and a second member; said first member having a first connecting means; said second member having a second connecting means; said first connecting means and said second connecting means being capable of uniting to form said first cover; said first side panel having a first side interior surface; and a first interior pocket connecting with said first side interior surface in said storage region.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; said plurality of first side pockets being identified as a first pocket, a second pocket, and a third pocket; said plurality of second side pockets being identified as a fourth pocket, a fifth pocket, and a sixth pocket; three passageways in said first side cover and identified as a first passageway, a second passageway, and a third passageway; three passageways in said second side cover and identified as a fourth passageway, a fifth passageway, and a sixth passageway; said first passageway being aligned with said first pocket; said second passageway being aligned with said second pocket; said third passageway being aligned with said third pocket; said fourth passageway being aligned with said fourth pocket; said fifth passageway being aligned with said fifth pocket; said sixth passageway being aligned with said sixth pocket; a seventh passageway in said first side panel and positioned between said first side cover and said third side cover and being aligned with said first passageway; an eighth passageway in said first side panel and positioned between said first side cover and said third side cover and being aligned with said second passageway; a ninth passageway in said first side panel and positioned between said first side cover and said third side cover and being aligned with said third passageway; a tenth passageway in said second side panel and positioned between said second side cover and said fourth side cover and being aligned with said fourth passageway; an eleventh passageway in said second side panel and positioned between said second side cover and said fourth side cover and being aligned with said fifth passageway; and a twelfth passageway in said second side panel and positioned between said second side cover and said fourth side cover and being aligned with said sixth passageway.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; said plurality of first side pockets being identified as a first pocket, a second pocket, and a third pocket; said plurality of second side pockets being identified as a fourth pocket, a fifth pocket, and a sixth pocket; three passageways in said first side cover and identified as a first passageway, a second passageway, and a third passageway; three passageways in said second side cover and identified as a fourth passageway, a fifth passageway, and a sixth passageway; said first passageway being aligned with said first pocket; said second passageway being aligned with said second pocket; said third passageway being aligned with said third pocket; said fourth passageway being aligned with said fourth pocket; said fifth passageway being aligned with said fifth pocket; said sixth passageway being aligned with said sixth pocket; a seventh passageway in said first side panel and positioned between said first side cover and said third side cover and being aligned with said first passageway; an eighth passageway in said first side panel and positioned between said first side cover and said third side cover and being aligned with said second passageway; a ninth passageway in said first side panel and positioned between said first side cover and said third side cover and being aligned with said third passageway; a tenth passageway in said second side panel and positioned between said second side cover and said fourth side cover and being aligned with said fourth passageway; an eleventh passageway in said second side panel and positioned between said second side cover and said fourth side cover and being aligned with said fifth passageway; a twelfth passageway in said second side panel and positioned between said second side cover and said fourth side cover and being aligned with said sixth passageway; said first cover comprising a first member and a second member; said first member having a first connecting means; said second member having a second connecting means; and said first connecting means and said second connecting means being capable of uniting to form said first cover.

A bag having a storage region holding articles and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; said first end panel having an exterior surface; a first end pocket connecting with said exterior surface of said first end panel; said second end panel having an exterior surface; a second end pocket connecting with said exterior surface of said second end panel; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; said plurality of first side pockets being identified as a first pocket, a second pocket, and a third pocket; said plurality of second side pockets being identified as a fourth pocket, a fifth pocket, and a sixth pocket; three passageways in said first side cover and identified as a first passageway, a second passageway, and a third passageway; three passageways in said second side cover and identified as a fourth passageway, a fifth passageway, and a sixth passageway; said first passageway being aligned with said first pocket; said second passageway being aligned with said second pocket; said third passageway being aligned with said third pocket; said fourth passageway being aligned with said fourth pocket; said fifth passageway being aligned with said fifth pocket; said sixth passageway being aligned with said sixth pocket; a seventh passageway in said first side panel and positioned between said first side cover and said third side cover and being aligned with said first passageway; an eighth passageway in said first side panel and positioned between said first side cover and said third side cover and being aligned with said second passageway; a ninth passageway in said first side panel and positioned between said first side cover and said third side cover and being aligned with said third passageway; a tenth passageway in said second side panel and positioned between said second side cover and said fourth side cover and being aligned with said fourth passageway; an eleventh passageway in said second side panel and positioned between said second side cover and said fourth side cover and being aligned with said fifth passageway; a twelfth passageway in said second side panel and positioned between said second side cover and said fourth side cover and being aligned with said sixth passageway; said first cover comprising a first member and a second member; said first member having a first connecting means; said second member having a second connecting means; said first connecting means and said second connecting means being capable of uniting to form said first cover; said first side panel having a first side interior surface; and a first interior pocket connecting with said first side interior surface in said storage region.

A bag having a central storage region and yarn and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; a first passageway in said first side cover; said first passageway being aligned with one of said plurality of first side pockets; a second passageway in said first side panel and positioned between said first side cover and said third side cover; said first passageway and said second passageway being aligned; and yarn in one of said plurality of said first side pockets and in said first passageway in said first side cover and in said second passageway in said first side panel and in said storage region.

A bag having a central storage region and yarn and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; a first passageway in said first side cover; said first passageway being aligned with one of said plurality of first side pockets; a second passageway in said first side panel and positioned between said first side cover and said third side cover; said first passageway and said second passageway being aligned; yarn in one of said plurality of said first side pockets and in said first passageway in said first side cover and in said second passageway in said first side panel and in said storage region; said plurality of first side pockets being identified as a first pocket, a second pocket, and a third pocket; said plurality of second side pockets being identified as a fourth pocket, a fifth pocket, and a sixth pocket; three passageways in said first side cover and identified as a first passageway, a second passageway, and a third passageway; three passageways in said second side cover and identified as a fourth passageway, a fifth passageway, and a sixth passageway; said first passageway being aligned with said first pocket; said second passageway being aligned with said second pocket; said third passageway being aligned with said third pocket; said fourth passageway being aligned with said fourth pocket; said fifth passageway being aligned with said fifth pocket; said sixth passageway being aligned with said sixth pocket; a seventh passageway in said first side panel and positioned between said first side cover and said third side cover and being aligned with said first passageway; an eighth passageway in said first side panel and positioned between said first side cover and said third side cover and being aligned with said second passageway; a ninth passageway in said first side panel and positioned between said first side cover and said third side cover and being aligned with said third passageway; a tenth passageway in said second side panel and positioned between said second side cover and said fourth side cover and being aligned with said fourth passageway; an eleventh passageway in said second side panel and positioned between said second side cover and said fourth side cover and being aligned with said fifth passageway; and a twelfth passageway in said second side panel and positioned between said second side cover and said fourth side cover and being aligned with said sixth passageway.

A bag having a central storage region and yarn and comprising a central panel comprising a base having a first end panel and a second end panel; said first end panel and said second end panel being at substantially a right angle to said base; said base having a first side and a second side; a first side panel connecting with said first side of said base and with said first end panel and with said second end panel; a second side panel connecting with said second side of said base and with said first end panel and with said second end panel; said first side panel having a first exterior surface; a plurality of first side pockets connecting with said first exterior surface; said second side panel having a second exterior surface; a plurality of second side pockets connecting with said second exterior surface; said central panel and said first side panel and said second side panel defining said storage region; a first side cover connecting with said first side panel and positioned to cover said first side pockets and connected to said first side panel; a second side cover connecting with said second side panel and positioned to cover said second side pockets and connected to said second side panel; a third side cover connecting with said first side panel and positioned to cover said first side cover; a fourth side cover connecting with said second side panel and positioned to cover said second side cover; a first passageway in said first side cover; said first passageway being aligned with one of said plurality of first side pockets; a second passageway in said first side panel and positioned between said first side cover and said third side cover; said first passageway and said second passageway being aligned; yarn in one of said plurality of said first side pockets and in said first passageway in said first side cover and in said second passageway in said first side panel and in said storage region; said plurality of first side pockets being identified as a first pocket, a second pocket, and a third pocket; said plurality of second side pockets being identified as a fourth pocket, a fifth pocket, and a sixth pocket; three passageways in said first side cover and identified as a first passageway, a second passageway, and a third passageway; three passageways in said second side cover and identified as a fourth passageway, a fifth passageway, and a sixth passageway; said first passageway being aligned with said first pocket; said second passageway being aligned with said second pocket; said third passageway being aligned with said third pocket; said fourth passageway being aligned with said fourth pocket; said fifth passageway being aligned with said fifth pocket; said sixth passageway being aligned with said sixth pocket; a seventh passageway in said first side panel and positioned between said first side cover and said third side cover and being aligned with said first passageway; an eighth passageway in said first side panel and positioned between said first side cover and said third side cover and being aligned with said second passageway; a ninth passageway in said first side panel and positioned between said first side cover and said third side cover and being aligned with said third passageway; a tenth passageway in said second side panel and positioned between said second side cover and said fourth side cover and being aligned with said fourth passageway; an eleventh passageway in said second side panel and positioned between said second side cover and said fourth side cover and being aligned with said fifth passageway; a twelfth passageway in said second side panel and positioned between said second side cover and said fourth side cover and being aligned with said sixth passageway; a first cover for said storage region; and said first cover connecting with said first side panel and with said second side panel.

What I claim is:

1. A bag having a storage region holding articles and comprising:

a. a central panel comprising a base having a first end panel and a second end panel;

b. said first end panel and said second end panel being at substantially a right angle to said base;

c. said base having a first side and a second side;

d. a first side panel connecting with said first side of said base and with said first end panel and with said second end panel;

e. a second side panel connecting with said second side of said base and with said first end panel and with said second end panel;

f. said first side panel having a first exterior surface;

g. a plurality of first side pockets connecting with said first exterior surface;

h. said second side panel having a second exterior surface;

i. a plurality of second side pockets connecting with said second exterior surface;

j. said central panel and said first side panel and said second side panel defining said storage region;

k. said first end panel having an exterior surface;

l. a first end pocket connecting with said exterior surface of said first end panel;

m. said second end panel having an exterior surface;

n. a second end pocket connecting with said exterior surface of said second end panel;

o. a first side cover connecting with said first side panel and positioned to cover said first side pockets and connected to said first side panel;

p. a second side cover connecting with said second side panel and positioned to cover said second side pockets and connected to said second side panel;

q. a third side cover connecting with said first side panel and positioned to cover said first side cover; and r. a fourth side cover connecting with said second side panel and positioned to cover said second side cover.

2. A bag according to claim 1 and comprising:

a. a first passageway in said first side cover;

b. said first passageway being aligned with one of said plurality of first side pockets;

c. a second passageway in said first side panel and positioned between said first side cover and said third side cover; and d. said first passageway and said second passageway being aligned.

3. A bag according to claim 2 and comprising:

a. a first cover for said storage region;

b. said first cover connecting with said first side panel and with said second side panel c. said first cover comprising a first member and a second member;

d. said first member having a first connecting means;

e. said second member having a second connecting means; and f. said first connecting means and said second connecting means being capable of uniting to form said first cover.

4. A bag according to claim 3 and comprising:

a. said first side panel having a first side interior surface; and b. a first interior pocket connecting with said first side interior surface in said storage region.

5. A bag according to claim 1 and comprising:

a. said plurality of first side pockets being identified as a first pocket, a second pocket, and a third pocket;

b. said plurality of second side pockets being identified as a fourth pocket, a fifth pocket, and a sixth pocket;

c. three passageways in said first side cover and identified as a first passageway, a second passageway, and a third passageway;

d. three passageways in said second side cover and identified as a fourth passageway, a fifth passageway, and a sixth passageway;

e. said first passageway being aligned with said first pocket;

f. said second passageway being aligned with said second pocket;

g. said third passageway being aligned with said third pocket;

h. said fourth passageway being aligned with said fourth pocket;

i. said fifth passageway being aligned with said fifth pocket;

j. said sixth passageway being aligned with said sixth pocket;

k. a seventh passageway in said first side panel and positioned between said first side cover and said third side cover and being aligned with said first passageway;

l. an eighth passageway in said first side panel and positioned between said first side cover and said third side cover and being aligned with said second passageway;

m. a ninth passageway in said first side panel and positioned between said first side cover and said third side cover and being aligned with said third passageway;

n. a tenth passageway in said second side panel and positioned between said second side cover and said fourth side cover and being aligned with said fourth passageway;

o. an eleventh passageway in said second side panel and positioned between said second side cover and said fourth side cover and being aligned with said fifth passageway; and p. a twelfth passageway in said second side panel and positioned between said second side cover and said fourth side cover and being aligned with said sixth passageway.

6. A bag according to claim 5 and comprising:

a. said first cover comprising a first member and a second member;

d. said first member having a first connecting means;

e. said second member having a second connecting means; and f. said first connecting means and said second connecting means being capable of uniting to form said first cover.

7. A bag according to claim 6 and comprising:

a. said first side panel having a first side interior surface; and b. a first interior pocket connecting with said first side interior surface in said storage region.

8. A bag having a central storage region and yarn and comprising:

a. a central panel comprising a base having a first end panel and a second end panel;

b. said first end panel and said second end panel being at substantially a right angle to said base;

c. said base having a first side and a second side;

d. a first side panel connecting with said first side of said base and with said first end panel and with said second end panel;

e. a second side panel connecting with said second side of said base and with said first end panel and with said second end panel;

f. said first side panel having a first exterior surface;

g. a plurality of first side pockets connecting with said first exterior surface;

h. said second side panel having a second exterior surface;

i. a plurality of second side pockets connecting with said second exterior surface;

j. said central panel and said first side panel and said second side panel defining said storage region;

k. a first side cover connecting with said first side panel and positioned to cover said first side pockets and connected to said first side panel;

l. a second side cover connecting with said second side panel and positioned to cover said second side pockets and connected to said second side panel;

m. a third side cover connecting with said first side panel and positioned to cover said first side cover;

n. a fourth side cover connecting with said second side panel and positioned to cover said second side cover;

o. a first passageway in said first side cover;

p. said first passageway being aligned with one of said plurality of first side pockets;

q. a second passageway in said first side panel and positioned between said first side cover and said third side cover;

r. said first passageway and said second passageway being aligned; and s. yarn in one of said plurality of said first side pockets and in said first passageway in said first side cover and in said second passageway in said first side panel and in said storage region.

9. A bag according to claim 8 and comprising:

a. said plurality of first side pockets being identified as a first pocket, a second pocket, and a third pocket;

b. said plurality of second side pockets being identified as a fourth pocket, a fifth pocket, and a sixth pocket;

c. three passageways in said first side cover and identified as a first passageway, a second passageway, and a third passageway;

d. three passageways in said second side cover and identified as a fourth passageway, a fifth passageway, and a sixth passageway;

e. said first passageway being aligned with said first pocket;

f. said second passageway being aligned with said second pocket;

g. said third passageway being aligned with said third pocket;

h. said fourth passageway being aligned with said fourth pocket;

i. said fifth passageway being aligned with said fifth pocket;

j. said sixth passageway being aligned with said sixth pocket;

k. a seventh passageway in said first side panel and positioned between said first side cover and said third side cover and being aligned with said first passageway;

l. an eighth passageway in said first side panel and positioned between said first side cover and said third side cover and being aligned with said second passageway;

m. a ninth passageway in said first side panel and positioned between said first side cover and said third side cover and being aligned with said third passageway;

n. a tenth passageway in said second side panel and positioned between said second side cover and said fourth side cover and being aligned with said fourth passageway;

o. an eleventh passageway in said second side panel and positioned between said second side cover and said fourth side cover and being aligned with said fifth passageway; and p. a twelfth passageway in said second side panel and positioned between said second side cover and said fourth side cover and to being aligned with said sixth passageway.

10. A bag according to claim 9 and comprising:

a. a first cover for said storage region; and b. said first cover connecting with said first side panel and with said second side panel.

11. A bag according to claim 10 and comprising:

a. said first end panel having an exterior surface;

b. a first end pocket connecting with said exterior surface of said first end panel;

c. said second end panel having an exterior surface; and d. a second end pocket connecting with said exterior surface of said second end panel.

12. A bag according to claim 11 and comprising:

a. a first cover for said storage region;

b. said first cover connecting with said first side panel and with said second side panel c. said first cover comprising a first member and a second member;

d. said first member having a first connecting means;

e. said second member having a second connecting means; and f. said first connecting means and said second connecting means being capable of uniting to form said first cover.

13. A bag according to claim 12 and comprising:

a. said first side panel having a first side interior surface; and b. a first interior pocket connecting with said first side interior surface in said storage region.

* * * * *